US010830020B2

(12) United States Patent
Xu et al.

(10) Patent No.: US 10,830,020 B2
(45) **Date of Patent: *Nov. 10, 2020**

(54) TOOL ASSEMBLY WITH A FLUIDIC AGITATOR AND A COATING

(71) Applicants: CNPC USA Corporation, Houston, TX (US); Beijing Huamei Inc. CNPC, Beijing (CN)

(72) Inventors: Jianhui Xu, Katy, TX (US); Ming Zhang, Spring, TX (US); Chris Cheng, Houston, TX (US); Yu Liu, Beijing (CN); Xiongwen Yang, Beijing (CN)

(73) Assignees: CNPC USA Corporation, Houston, TX (US); Beijing Huamei Inc., Beijing (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/658,967

(22) Filed: Oct. 21, 2019

(65) Prior Publication Data

US 2020/0048993 A1 Feb. 13, 2020

Related U.S. Application Data

(63) Continuation-in-part of application No. 15/820,273, filed on Nov. 21, 2017, now Pat. No. 10,450,819.

(51) Int. Cl.

| | |
|---|---|
| ***E21B 28/00*** | (2006.01) |
| ***E21B 41/02*** | (2006.01) |
| ***E21B 31/00*** | (2006.01) |

(52) U.S. Cl.

CPC ..... *E21B 41/02* (2013.01); *E21B 31/005* (2013.01)

(58) Field of Classification Search

CPC ..... E21B 31/005; E21B 28/00

USPC ..... 166/380

See application file for complete search history.

*Primary Examiner* — Taras P Bemko

(74) *Attorney, Agent, or Firm* — Craft Chu PLLC; Andrew W. Chu

(57) ABSTRACT

The tool assembly vibrates a casing string or drill string in a wellbore. The tool assembly includes a housing, an insert mounted in the housing as a fluidic agitator, a coating on the insert, and a cover fitted over the insert. The coating on the insert provides erosion resistance and a smooth surface compatible with high velocity fluid flow required to achieve the strength and frequency of desired high strength and low frequency pressure pulses.

20 Claims, 4 Drawing Sheets

TOOL ASSEMBLY WITH A FLUIDIC AGITATOR AND A COATING

CROSS-REFERENCE TO RELATED APPLICATIONS

The present application claims priority under 35 U.S.C. Section 120 from U.S. patent application Ser. No. 15/820,273, filed on 21 Nov. 2017, entitled "TOOL ASSEMBLY WITH A FLUIDIC AGITATOR" and issued as U.S. Pat. No. 10,450,819. See also Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to downhole tools in the oil and gas industry. More particularly, the present invention relates to a tool assembly to generate vibration on a casing string or drill string. The present invention also relates to controlling fluid flow oscillations.

2. Description of Related Art Including Information Disclosed Under 37 CFR 1.97 and 37 CFR 1.98.

Fluidic components, such as vortex chambers, fluidic switches and feedback loops, are already known to set the flow path through a variable resistance device of a downhole tool. A fluidic agitator generates vibration along a drill string or casing string, so that the respective string can pass bends and angles in the wellbore. The string can pass through tight turns instead of getting stuck on the edge of a rock formation. A fluidic oscillator can pulse the delivery of fluid so that control screens can be cleaned, scale can be removed from casing, and other chemical treatments can be effectively delivered to the downhole location by a pressure pulse. There has always been a need to control fluid flow through the wellbore.

U.S. Pat. No. 8,931,566, issued on 13 Jan. 2015 to Dykstra et al. describes a fluid agitator with curved fluid chamber having a fluid diode as a switch between two ports for generating vibration from the tubular housing of a downhole tool.

U.S. Pat. No. 8,944,160, issued on 3 Feb. 2015 to Surjaatmadja et al. discloses a fluidic agitator with pulsed fluid discharge for the vibration of the tubular string through the wellbore. The flow control relates to discharging fluid in a selected direction for the vibration of the tubular string along the wellbore. U.S. Pat. No. 9,328,587, issued on 3 May 2016 to Surjaatmadja et al. addresses the physical fluid chamber component of the fluidic agitator.

U.S. Pat. No. 9,260,952, issued on 16 Feb. 2016 to Fripp et al. discloses controlling fluid flow with a switch in a fluidic oscillator also. The device delivers fluids downhole as selected for various characteristics and conditions downhole. The fluid chamber relies on physical shapes and structures to split, switch, and shape fluid flow so that the output can be regulated autonomously.

U.S. Pat. No. 9,546,536, issued on 17 Jan. 2017 to Schultz et al., U.S. Pat. No. 9,316,065, issued on 19 Apr. 2016 to Schultz et al., and U.S. Pat. No. 9,212,522, issued on 15 Dec. 2015 to Schultz et al., all show the wide range of shapes and pathways for a fluid chamber. The different vortex chambers and numbers of vortex chambers, feedback loops and flow paths of feedback loops are shown. The tangential and radial connections, and the placement of outlets can also set the sequence of the flow path through the components to affect fluid flow.

US Patent Publication No. 20190153798, published on 23 May 2019 for the current Applicant, discloses a fluidic agitator in a tool assembly, such as a bottom hole assembly, which can be used during formation drilling. The bottom hole assembly with a fluidic agitator creates vibration along the drill string so as to prevent the bottom hole assembly from being stuck in the rock formation during drilling process. The fluidic agitator system is activated by a hydraulic pulse. In order to create a sufficient hydraulic pulse with the fluidic agitator, the hydraulic flow is typically high. The flow speed of fluid is very high. Therefore, the chambers and channels in the insert of the fluidic agitator experience high turbulence and erosion.

It is an object of the present invention to control fluid flow in a downhole tool.

It is an object of the present invention to provide a tool assembly with a fluidic agitator for vibrations in a wellbore.

It is another object of the present invention to provide a fluidic agitator with erosion resistance.

It is another object of the present invention to provide an insert of a fluidic agitator with a protective coating.

It is still another object of the present invention to provide an inlet chamber and vortex chamber of an insert with a coating.

It is another object of the present invention to provide a fluidic agitator with surface conditions for fluid flow.

It is still another object of the present invention to provide a fluidic agitator with hard surface coating.

These and other objectives and advantages of the present invention will become apparent from a reading of the attached specifications and appended claims.

BRIEF SUMMARY OF THE INVENTION

The tool assembly of the present invention is a fluidic agitator used in a downhole tool to vibrate the drill string so that the drill string can pass by curves and bends in the borehole. The vibrations reduce friction as the drill string rubs against the bend in a rock formation. The strength and frequency of the vibrations affect the efficiency and effectiveness of the fluidic agitator. The tool assembly has a pressure profile with multiple levels, such as a lower level, a middle level, and a higher level. Thus, the range of strength of the pressure pulses is greater than conventional fluidic agitators. Furthermore, the range of frequency of the higher level allows for lower frequency vibrations than conventional fluidic agitators.

In the present invention, high velocity fluid flow is required to achieve the strength and frequency of desired high strength and low frequency pressure pulses. The insert of the fluidic agitator is subjected to surface erosion on certain components of the insert. The tool assembly of the present invention includes a coating to protect the particularly vulnerable components of the insert. The coating is reliably applied to the insert as the substrate. The coating is hard to withstand the erosion from high speed fluid flow and smooth to allow fluid flow past the coating without significantly affecting the speed of the fluid flow.

The tool assembly includes a housing having an inlet and an outlet, an insert mounted in the housing, and a cover fitted over the insert in the housing. The cover seals the insert within the housing for installation in a casing string or drill string. Embodiments of the tool assembly include an insert comprising an inlet chamber, a vortex chamber, and a feedback chamber. The inlet chamber is in fluid connection with the inlet of the housing, and the vortex chamber has an output in fluid connection to the outlet of the housing. The fluid flow through the inlet at the input chamber, vortex chamber, and feedback chamber has a pressure profile with a plurality of levels, corresponding to the number of feedback chamber. Additionally, the pressure profile has a frequency determined by the feedback chamber when the input chamber maintains a constant position and fluid connection to the vortex chamber. In some embodiments, the input chamber, vortex chamber and feedback chamber are in an asymmetric flow path.

The insert includes a first input channel connecting the inlet chamber to one side of the vortex chamber, and a second input channel connecting the inlet chamber to an opposite side of the vortex chamber. There is a switch means in the input chamber based on the Coanda effect for the flow path alternating between the first input channel and the second input channel. The insert also includes a first transition channel connecting the vortex chamber to one side of the feedback chamber, and a second transition channel connecting the vortex chamber to an opposite side of the feedback chamber. There can also be a first flowback channel extending from the feedback chamber to the input chamber, and a second flowback channel extending from the feedback chamber to the input chamber. These flowback or feedback channels return fluid back to the input chamber.

Embodiments of the present invention include the coating covering the inlet chamber, the first input channel, the second input channel, and the vortex chamber. Additional embodiments include the coating also covering the first transition channel and the second transition channel and the coating covering the first transition channel, the second transition channel, the feedback chamber, the first flowback channel, and the second flowback channel. The coating can have a thickness of 0.005 inches to 0.200 inches and a hardness of HV 1215. The coating can include carbide, oxide, nitride, silicide, or metallic binder and can be bonded to the insert by sintering or plating.

Embodiments of the present invention include the method for fluid control in a wellbore. A coating is applied to the insert, and the tool is assembled with the coated insert with the inlet chamber, the vortex chamber, and the feedback chamber in an asymmetric flow path. The tool is installed in a string, and a fluid flows through the insert and over the coating, alternating the flow path between the first input channel and the second input channel. Vibrations are generated in the tool according to the pressure profile. The insert has a longer working life to withstand the high velocity fluid flow through the inlet chamber and vortex chamber. The reinforced components sustain the reliability of the insert under the harsh conditions of fluid flow at downhole locations.

DETAILED DESCRIPTION OF THE INVENTION

The tool assembly with fluidic agitator disclosed in US Patent Publication No. 20190153798, published on 23 May 2019 for the current Applicant, requires high velocity fluid flow through the fluidic agitator in order to achieve the strength and frequency of the desired vibrations or pressure pulses. The high velocity fluid flow erodes components in the insert of the fluidic agitator. The present invention is an improved tool assembly with a fluidic agitator and coating to extend the working life of tool assembly. The coating on certain portions of the insert maintains reliability and precision of the control of the efficiency and effectiveness of the fluid control tool assembly. The coating is hard and smooth to have erosion resistance without disrupting fluid flow past the coating. Due to the sensitivity of hydraulic pulse to the geometry of the components, the surface condition of this hard coating is also required to be smooth enough for fluid to pass the hard coating with less disruption to fluid flow.

Figure 1:
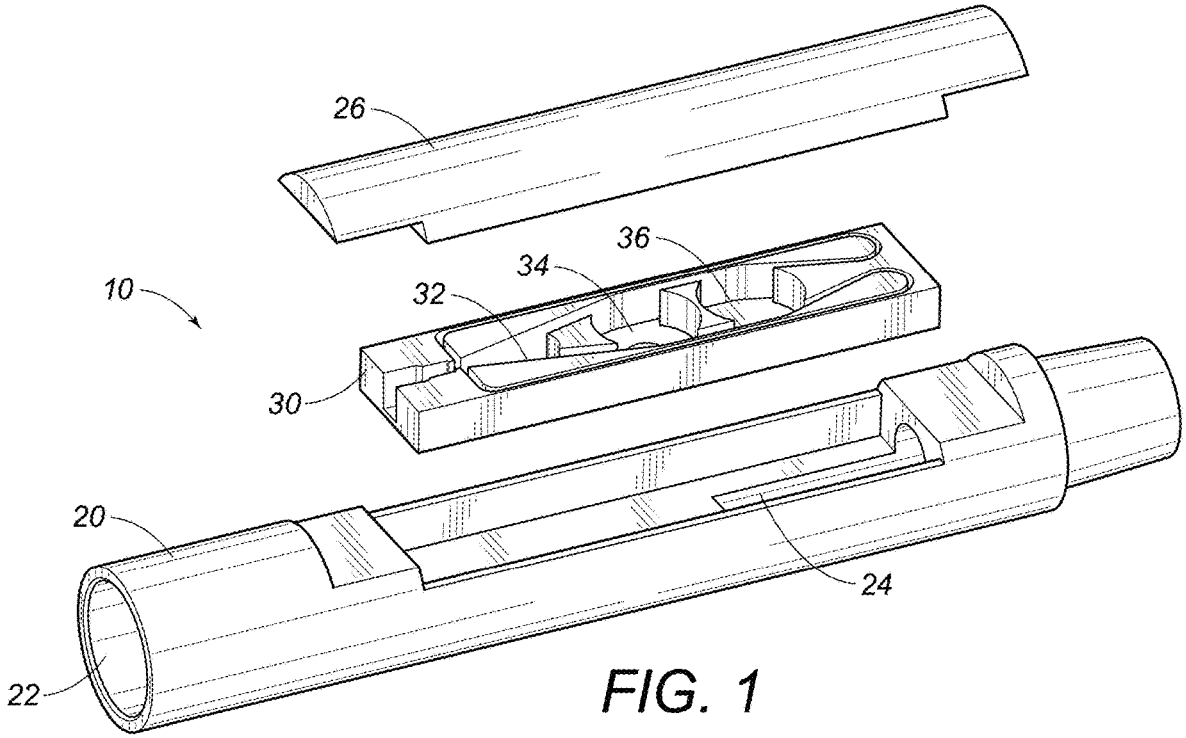
FIG. 1 is an exploded perspective view of the tool assembly, according to embodiments of the present invention.

Referring to FIGS. 1-5, the tool assembly 10 is a fluid control downhole tool that can be adapted for use as a fluidic agitator or a fluidic oscillator. FIG. 1 shows the tool assembly 10 for installation in a tubular string, such as a drill string or a casing string to be deployed in a wellbore. The tool assembly 10 includes a housing 20 having an inlet 22 and an outlet 24, an insert 30 mounted in the housing 20, and a cover 26 fitted over the insert 30 in the housing 20. The cover 26 seals the insert 30 within the housing 20 for installation in a casing string or drill string. The insert 30 comprises an inlet chamber 32, a vortex chamber 34, and a feedback chamber 36. The housing 20 and cover 26 can be adapted to be incorporated in a tubular string with fluid flow through the tool assembly 10 in line with the tubular string, which may extend from a surface location to a downhole location in a wellbore.

Figure 5:
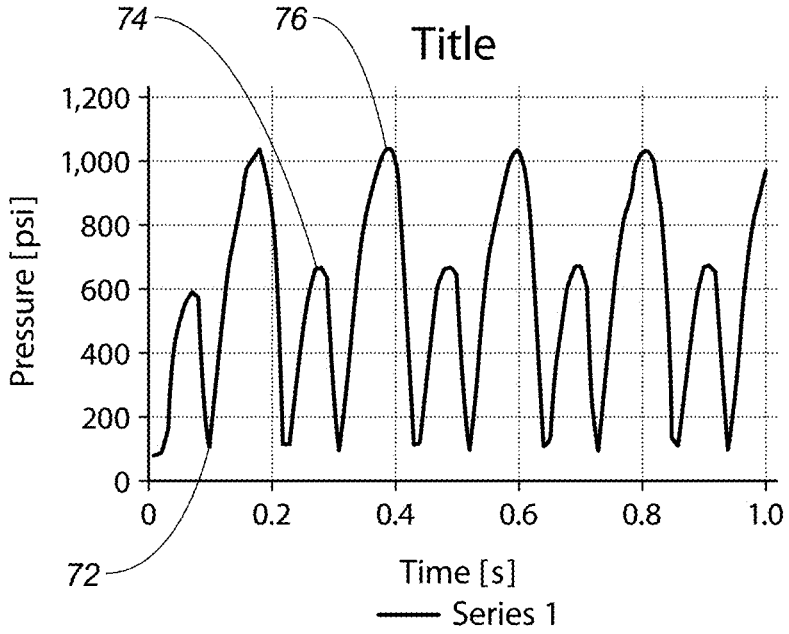
FIG. 5 is a graph illustration of the pressure profile of a fluid flow through the insert of the tool assembly, according to embodiments of the present invention.

As shown in FIG. 5, the fluid flow of the tool assembly 10 has a pressure profile with a plurality of levels. In this embodiment, there are three levels: a lower level 72, a middle level 74, and a higher level 76. The strength of the pressure pulse has a greater range than conventional fluidic oscillators and fluidic agitators. The build up and peak of the higher level 76 can be achieved with only the insert 30 of the present invention. The frequency between the higher level 76 pressure pulses has a greater range than conventional fluidic oscillators and fluidic agitators. The time between peaks of the higher level can be achieved at lower frequencies with only the insert 30 of the present invention. The tool assembly 10 provides for pressure pulses and vibrations downhole in the more desirable lower frequencies and stronger pulses for fluidic agitators.

Additionally, the pressure profile has a frequency determined by the feedback chamber 36 of the insert 30. With the feedback chamber 36 in fluid connection between the vortex chamber 34 and the input chamber 32, the input chamber 32 can be placed in a constant position and in fluid connection to the vortex chamber 34. Thus, the inlet 22 and the outlet 24 are matched with the input chamber 32 and vortex chamber 34. In some embodiments, the input chamber 32 and the vortex chamber 34 can be placed close together, just as the inlet 22 would be placed near the outlet 24. The feedback chamber 36 in the insert is positioned to regulate frequency as a buffer to delay feedback flow. The sizes of the inlet 22 and outlet 24 are no longer expanded or narrowed to control frequency, and the distance between the inlet 22 and input chamber 32 to the outlet 24 and the vortex chamber 34 are no longer extended or retracted to control frequency. The structure, size and arrangement of the insert 30 achieve the pressure profile with a plurality of levels with ranges of strength and frequency required for downhole activity.

Figure 2:
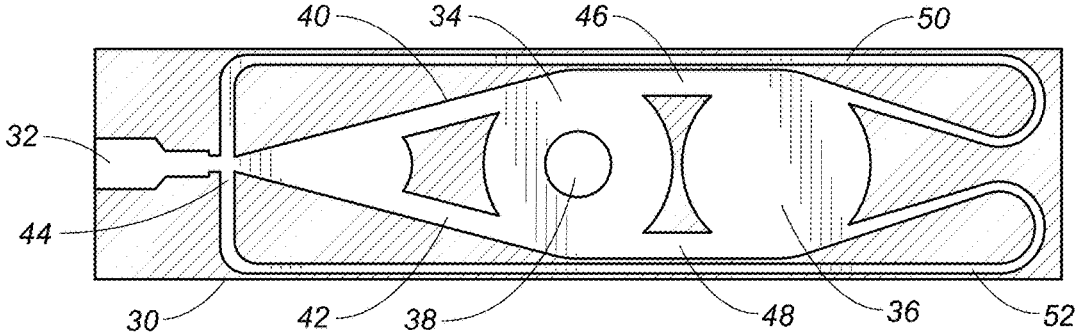
FIG. 2 is a longitudinal cross sectional view of an embodiment of an insert of the tool assembly according to embodiments of the present invention.
Figure 3:
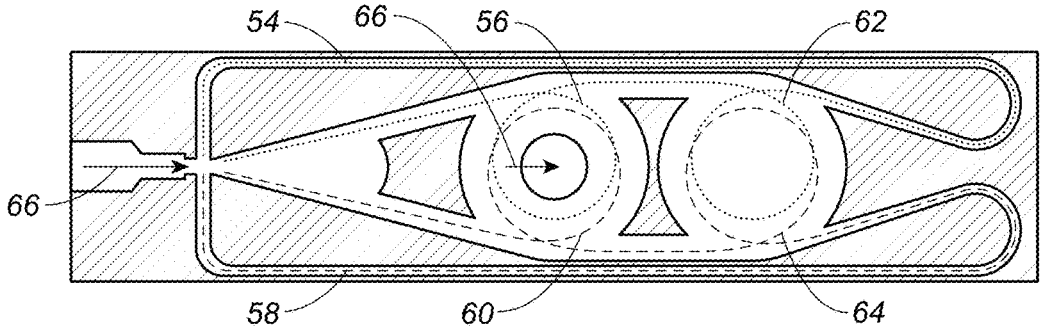
FIG. 3 is a longitudinal cross sectional view of an embodiment of an insert of the tool assembly according to embodiments of the present invention, showing flow paths.
Figure 4:
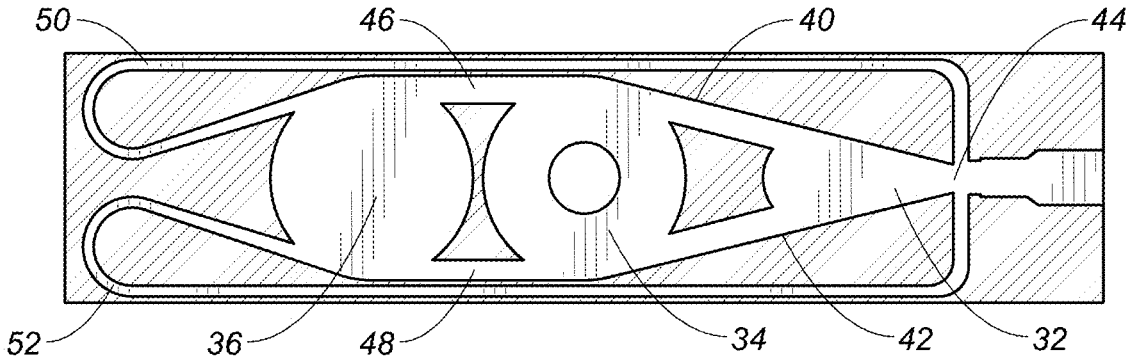
FIG. 4 is a schematic view of an embodiment of an asymmetric flow path through the insert of the tool assembly according to embodiments of the present invention.

Embodiments of the tool assembly 10 include an insert 30 comprising an inlet chamber 32, a vortex chamber 34, and a feedback chamber 36 in fluid connection between the vortex chamber 34 and the inlet chamber 32. The inlet chamber 32 is fluid connection with the vortex chamber 34 directly and through the feedback chamber 36, as shown in FIGS. 2-4. The inlet chamber 32 is in fluid connection with the inlet 22 of the housing 20, and the vortex chamber 34 has an output 38 in fluid connection to the outlet 24 of the housing 20. The fluid flow through the insert starts at the input 22 and moves through the input chamber 32, the vortex chamber 34, and the feedback chamber 36 with the exit through the output 38 in the vortex chamber 34. FIGS. 2-4 shows the insert 30 comprising a first input channel 40 connecting the inlet chamber 32 to one side of the vortex chamber 34, and a second input channel 42 connecting the inlet chamber 32 to an opposite side of the vortex chamber 34. The first and second input channels 40, 42 are mirror images of each other, being symmetrical in position along the longitudinal axis orientation or center line of the insert 30. FIGS. 2-4 show the first and second input channels 40, 42 each being tangent to the vortex chamber 34 in a symmetrical arrangement across a center line of the insert 30.

FIGS. 2-4 show the insert 30 having a switch means 44 in the input chamber 32. In some embodiments, the switch means 44 is based on the Coanda effect for a flow path alternating between the first input channel 40 and the second input channel 42. The switch means 44 can be other known fluidic switches, in addition to the Coanda-based embodiment of FIGS. 2-4.

The insert 30 also includes a first transition channel 46 connecting the vortex chamber 34 to one side of the feedback chamber 36, and a second transition channel 48 connecting the vortex chamber 34 to an opposite side of the feedback chamber 36. The feedback chamber 36 is in fluid connection to the vortex chamber 34. The first and second transition channels 46, 48 are mirror images of each other, being symmetrical in position along the longitudinal axis orientation or center line of the insert 30. FIGS. 2-4 show the first and second transition channels 46, 48 each being tangent to the vortex chamber 34 and the feedback chamber 36 in a symmetrical arrangement across a center line of the insert 30.

FIGS. 2-4 also show the insert 30 having a first flowback channel 50 extending from the feedback chamber 36 to the inlet chamber 32, and a second flowback channel 52 extending from the feedback chamber 36 to the inlet chamber 32. These flowback or feedback channels 50, 52 return fluid back to the input chamber 32. The first and second flowback channels 50, 52 are mirror images of each other, being symmetrical in position along the longitudinal axis orientation or center line of the insert 30, similar to the first and second input channels 40, 42. The embodiments show the flowback channels 50, 52 in tangent connections to the feedback chamber 36 in the same symmetric arrangement across the center line of the insert. The flowback channels 50, 52 are on different tangent connections than the transition channels 46, 48, and the flowback channels 50, 52 extend beyond the feedback chamber 36 before looping back past the feedback chamber 36, the vortex chamber 34, and then back to the inlet chamber 32.

Embodiments of the present invention include the inlet chamber 32, the vortex chamber 34, and the feedback chamber 36 in an asymmetric flow path 66. FIG. 4 shows the second transition channel 48 being larger than the first transition channel 46 so that the symmetry of the symmetrical arrangement is limited to the position of the tangent connections to the vortex chamber 34 and the feedback chamber 36. The embodiment of FIG. 4 shows the asymmetry of the asymmetric flow path 66 in this portion in the flow path. The first transition channel 46 has a width of about 6.0 mm, and the second transition channel 48 has a width of about 8.25 mm in this embodiment. Both transition channels 46, 48 remain in a symmetrical position on the vortex chamber 34 and the feedback chamber 36, but the transition channels 46, 48 are not identical. In alternative embodiments, the second transition channel 48 can be smaller in width than the first transition channel 46. The transition channels 46, 48 must be different, and the difference in width is one embodiment, while the positions relative to the vortex chamber 34 and the feedback chamber 36 remain in a symmetrical arrangement relative to the center line of the insert 30. Other dimensions, such as height or diameter may also be different between the transition channels 46, 48.

FIG. 4 shows the asymmetric flow path 66 being comprised of a first fluid flow path 54 from the inlet chamber 32 to the first input channel 40 and to the vortex chamber 34 in a first direction 56 around the vortex chamber 34, and a second fluid flow path 58 from the inlet chamber 32 to the second input channel 42 and to the vortex chamber 34 in a second direction 60 around the vortex chamber 34. The second direction 60 is opposite the first direction 56. The first input channel 40 and the second input channel 42 are both tangent to the vortex chamber 34 on opposing sides of the vortex chamber 34, being symmetrical across the center line of the insert 30.

The first fluid flow path 54 continues from the vortex chamber 34 to the feedback chamber 36 by the first transition channel 46 and is in a first circulation direction 62 around the feedback chamber 36. The second fluid flow path 58 continues from the vortex chamber 34 to the feedback chamber 36 by the second transition channel 48 and is in a second circulation direction 64 around the feedback chamber 36. The second circulation direction 64 is opposite the first circulation direction 62. In FIGS. 2-4, the first transition channel 46 is tangent to the vortex chamber 34 and the feedback chamber 36, while the second transition channel 48 is tangent to the vortex chamber 34 and the feedback chamber 36, in the same symmetrical arrangement relative to the center line of the insert 30. The dimensions of the transition channels 46, 48 are different, but the positions of connections relative to the vortex chamber 34 and the feedback chamber 36 are the same.

Figure 8:
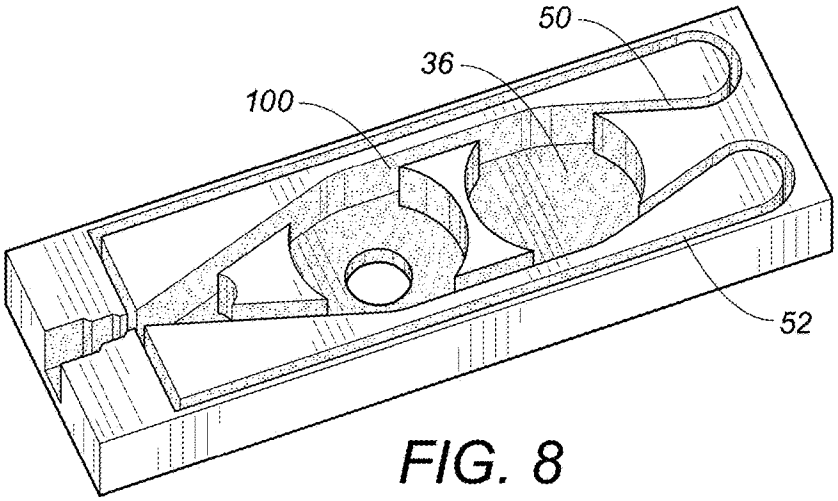
FIG. 8 is a perspective view of an embodiment of the coating on the inlet chamber, the first input channel, the second input channel, the first transitional channel, the second transition channel, the feedback chamber, the first flowback channel, the second flowback channel, and the vortex chamber.
Figure 6:
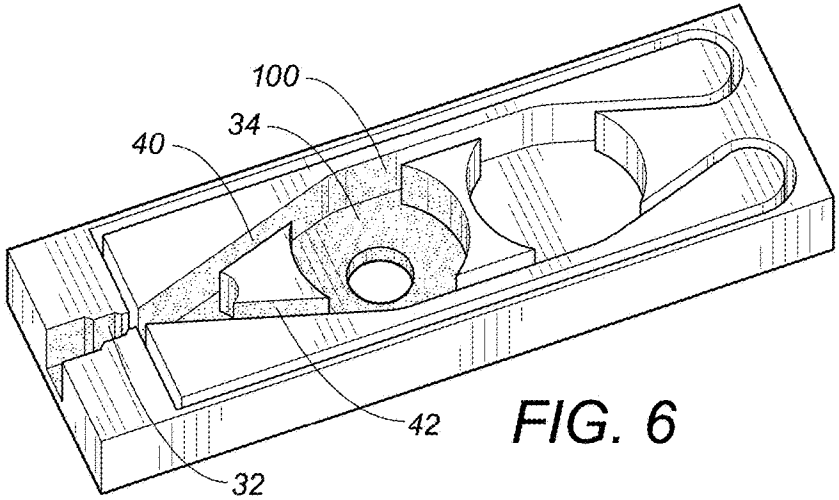
FIG. 6 is a perspective view of an embodiment of the coating on the inlet chamber, the first input channel, the second input channel, and the vortex chamber.
Figure 7:
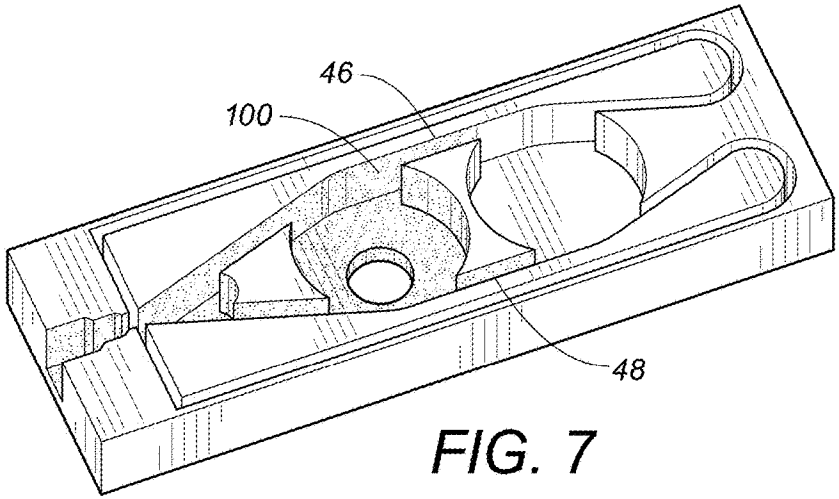
FIG. 7 is a perspective view of an embodiment of the coating on the inlet chamber, the first input channel, the second input channel, the first transitional channel, the second transition channel, and the vortex chamber.

FIGS. 6-8 show the embodiments of the present invention as the improved tool assembly 10 with a fluidic agitator and a coating 100. FIG. 6 shows the coating 100 covering the inlet chamber 32, the first input channel 40, the second input channel 42, and the vortex chamber 34. FIG. 7 shows the coating 100 covering the inlet chamber 32, the first input channel 40, the second input channel 42, the first transition channel 46, the second transitional channel 48, and the vortex chamber 34. FIG. 8 shows the coating 100 covering the inlet chamber 32, the first input channel 40, the second input channel 42, the first transition channel 46, the second transitional channel 48, the first flowback channel 50, the second flowback channel 52, the feedback chamber 36, and the vortex chamber 34. The coating 100 can have a thickness of 0.0005 inches to 0.200 inches with a hardness of HV 600. The coating should have hardness at least two times greater than the hardness of the insert, usually steel at around HV 300. Some embodiments have a hardness (HV 1215) about four times the hardness of the substrate.

In some embodiments, coating is comprised of at least one of a group consisting of carbide, oxide, nitride, and silicide. These compounds are hard particles to withstand erosion. For example, the coating can be comprised of a carbide and metallic binder, that forms a sintered coating bonding the coating to the insert as the substrate. In one embodiment, the coating can include a flexible cloth containing carbide with the metallic binder. The cloth is placed on the component of the insert to be covered, and the insert undergoes a sintering process in a furnace to create the metallurgical bonding between the coating and the substrate, i.e., the component of the insert, to provide erosion resistance. Another embodiment is the coating as a particle paste. The hard particles in a paste form can also be applied on the component of the insert to be covered, and the insert undergoes another sintering process in a furnace to create the metallurgical bonding between the coating and the substrate, i.e., the component of the insert, to provide erosion resistance.

Figure 9:
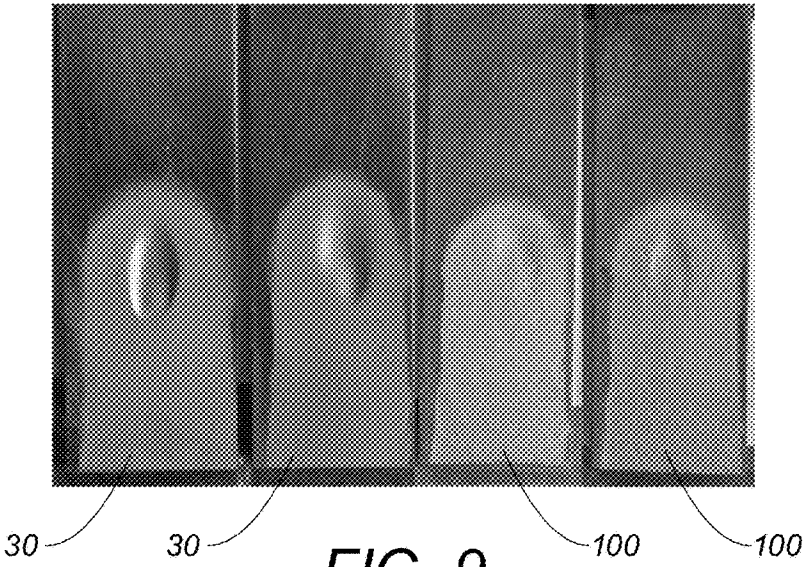
FIG. 9 is a photo illustration of samples of steel substrate of an insert and a coating on a steel substrate of an insert in slurry erosion tests.

In an alternate embodiment, the coating can be chrome, nickel or other deposited material. The coating can be a plated coating that can be completed by at least one of the following processes: chrome plating, electroless nickel, chemical vapor deposition, physical vapor deposition, etc. The coating is a plated coating so as to deposit the coating on a component of the insert. FIG. 9 for all components being covered by the coating 100 shows a more typical version of a plated coating.

Figure 10:
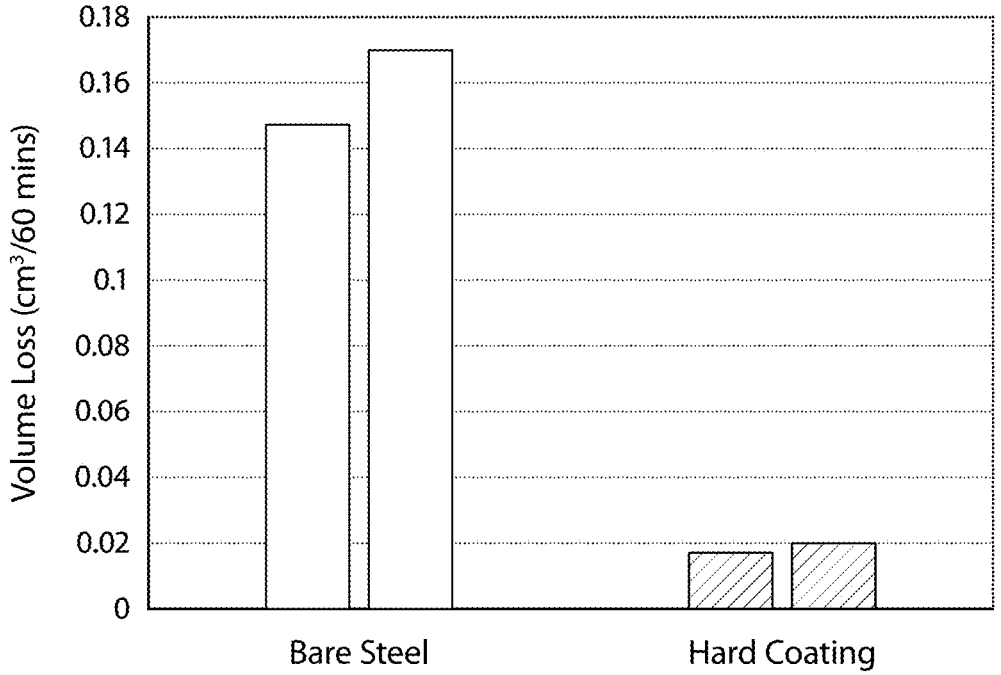
FIG. 10 are graph illustrations of erosion volume loss and maximum depth of erosion cavities.
Figure 10:
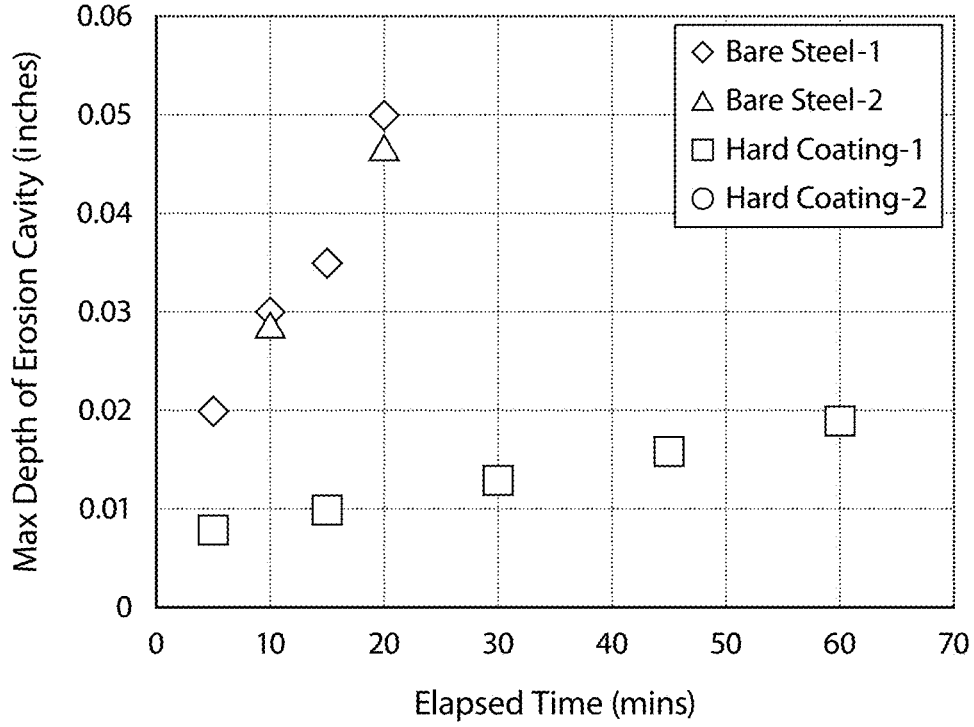

FIG. 9 show photo illustrations of photo illustration of samples of steel substrate of an insert and a coating on a steel substrate of an insert in slurry erosion tests. FIG. 10 are graph illustrations of erosion volume loss and maximum depth of erosion cavities. The coating 100 has an erosion resistance at least two times greater an erosion resistance of the insert as the substrate. FIG. 10 shows a version with an erosion resistance eight times greater. FIG. 10 further shows a volume loss of the coating is 11% of a volume loss of the insert as the substrate.

Embodiments of the present invention include the method for fluid control in a wellbore, which can be used for vibrating a casing string or drill string in the wellbore. The method includes applying a coating 100 to an insert 30. The method further includes assembling the tool 10 with the insert 30 having the feedback chamber 36 between the vortex chamber 34 and the input chamber 32 with the input chamber 32 in fluid connection with the vortex chamber 34 directly and through the feedback chamber 36, installing the tool 10 on a tubular string, such as a casing string or drill string, flowing a fluid through the insert 30 with a pressure profile with a plurality of levels, such as lower 72, middle 74 and higher 76 levels, and generating vibrations in the tool 10 according to the pressure profile. The feedback chamber 36 is a generally round cavity in the insert 30 without an output. Fluid can flow around in the feedback chamber 36, similar to a vortex chamber, except that there is no output for the fluid to leave the feedback chamber in the center of the feedback chamber. In some embodiments, the feedback chamber 36 is a circulation chamber positioned on the feedback side of the vortex chamber 34. The placement of the feedback chamber 36 creates a buffer to delay feedback flow to the input chamber. Previously, the feedback channels were lengthened or double backed to the input chamber, but there was no flow or circulation arrangement of the feedback chamber 36. The fluid must exit through the transition channel or flowback channel, which are tangent to the feedback chamber in FIGS. 2-4. In series with a vortex chamber, the feedback chamber 36 of the present invention is in fluid connection through transition channels 46, 48.

FIGS. 6-8 show the coating 100 covering the inlet chamber 32, the first input channel 40, the second input channel 42, and the vortex chamber 34. The first transition channel 46, the second transitional channel 48, the first flowback channel 50, the second flowback channel 52, and the feedback chamber 36, can also be covered.

The method includes progression of the step of flowing a fluid through the insert 30 and over the coating 100.

When the insert 30 is comprised of a switch 44, the first input channel 40 and the second input channel 42 in fluid connection between the inlet chamber 32 and the vortex chamber 34, the step of flowing the fluid includes alternating the flow between the first input channel 40 and the second input channel 42 for the first fluid flow path 54 and the second fluid flow path 58 of the asymmetric flow path 66. In the vortex chamber 34, the first fluid flow path 54 is in a first direction 56 around the vortex chamber 34, while the second fluid flow path 58 can be in a second direction 60 around the vortex chamber 34 in the opposite direction. The connections to the vortex chamber 34 are on opposite sides for symmetrical positions along the center line of the insert 30.

The step of flowing the fluid through the insert 30 can further include flowing the fluid over the coating 100 and between the vortex chamber 34 and the feedback chamber 36. FIGS. 2-4 show the first transition channel 46 and the second transition channel 48 for this step of flowing. The flowing between the vortex chamber 34 and the feedback chamber 36 corresponds to the step of alternating the flow path, so that the flow through the larger second transition channel 48 is different than the flow through the smaller first transition channel 46. This flow path is an asymmetric flow path 66 due to the first and second transition channels 46, 48. The connections to the vortex chamber 34 and the feedback chamber 36 are also tangent connections on opposite sides for symmetrical positions along the center line. However, the first and second transition channels 46, 48 are different so that the flow path remains asymmetric, despite the symmetry in the positions around the vortex chamber 34 and the feedback chamber 36.

Since the step of flowing between the vortex chamber 34 and the feedback chamber 36 corresponds to the step of alternating, the first fluid flow path 54 and the second fluid flow path 56 are similarly related in the feedback chamber 36. In the feedback chamber 36, the first fluid flow path 54 is in a first circulation direction 62 around the feedback chamber 36, while the second fluid flow path 58 can be in a second circulation direction 64 around the feedback chamber 36 in the opposite direction to the first circulation direction 62. The connections to the vortex chamber 34 and the feedback chamber 36 are on opposite sides for symmetrical positions along the center line of the insert 30 and tangent to both the vortex chamber 34 and the feedback chamber 36.

The step of applying a coating to an insert can include sintering at least one of a group consisting of carbide, oxide, nitride, and silicide so as to bond the coating to the insert. Alternatively, the step of applying a coating can include plating at least one of a group consisting of chrome and nickel, such as electroless nickel to the insert. Known embodiments for the step of plating include chrome plating, electroless nickel plating, chemical vapor deposition, and physical vapor deposition.

The present invention can preserve the working life of a fluidic agitators and fluidic oscillators with coatings. The tool assembly of the present invention is typically used for a fluidic agitator requiring high velocity fluid flow to generate the vibrations in a wellbore with the desired strength and frequency. The vibration of a tubular string, such as a drill string or casing string, allows the tubular string to pass through the rock formations in the wellbore more easily and with less risk of damage to the string. The tool assembly includes an insert with a coating to provide erosion resistance. The coating is a protective coating for components of the insert that may experience erosion, which may affect the reliability and control of the pressure profile. The fluid flow can be sensitive to geometry of the components, so the shape of the components and surface texture of the components are important. The coating must be hard and smooth to protect and to allow the fluid to pass the coating affecting the fluid flow speed as little as possible. The coating can be placed on certain components, such as at least the inlet chamber, first input channel, second input channel, and vortex chamber. The tool assembly with a fluidic agitator and coating is more reliable and precise for a longer working life.

The foregoing disclosure and description of the invention is illustrative and explanatory thereof. Various changes in the details of the illustrated structures, construction and method can be made without departing from the true spirit of the invention.

We claim:

1. A tool assembly for deployment into a wellbore, the tool assembly comprising:

a housing having an inlet and an outlet;

an insert mounted in said housing;

a cover fitted over said insert in said housing, said cover sealing said insert within said housing, wherein said insert comprises an inlet chamber, a vortex chamber, and a feedback chamber, said feedback chamber being in fluid connection with said vortex chamber and said inlet chamber, said inlet chamber being in fluid connection with said vortex chamber directly and through said feedback chamber, wherein said insert comprises:

a first input channel connecting said inlet chamber to one side of said vortex chamber;

a second input channel connecting said inlet chamber to an opposite side of said vortex chamber;

a first transition channel connecting said vortex chamber to one side of said feedback chamber;

a second transition channel connecting said vortex chamber to an opposite side of said feedback chamber;

a first flowback channel extending from said feedback chamber to said inlet chamber; and a second flowback channel extending from said feedback chamber to said inlet chamber; and a coating covering said inlet chamber, said first input channel, said second input channel, and said vortex chamber, wherein fluid flow through said insert has a pressure profile comprised of a plurality of levels determined by said feedback chamber, wherein said pressure profile has a frequency determined by said feedback chamber, when said inlet chamber maintains a constant position and fluid connection to said vortex chamber, and wherein said inlet chamber, said vortex chamber, and said feedback chamber are in an asymmetric flow path.

2. The tool assembly, according to claim 1, wherein said coating covers said first transition channel and said second transition channel.

3. The tool assembly, according to claim 1, wherein said coating covers said first transition channel, said second transition channel, said feedback chamber, said first flowback channel, and said second flowback channel.

4. The tool assembly, according to claim 1, wherein said coating has a thickness of 0.0005 inches to 0.200 inches.

5. The tool assembly, according to claim 1, wherein said coating is comprised of at least one of a group consisting of carbide, oxide, nitride, and silicide.

6. The tool assembly, according to claim 5, wherein said coating is comprised of a carbide and metallic binder.

7. The tool assembly, according to claim 6, wherein said coating is a sintered coating so as to bond said coating to said insert.

8. The tool assembly, according to claim 5, wherein said coating is comprised of a particle paste.

9. The tool assembly, according to claim 8, wherein said coating is a sintered coating so as to bond said coating to said insert.

10. The tool assembly, according to claim 5, wherein said coating is further comprised of a particle cloth.

11. The tool assembly, according to claim 10, wherein said coating is a sintered coating so as to bond said coating to said insert.

12. The tool assembly, according to claim 1, wherein said coating is comprised of at least one of a group consisting of: chrome and nickel.

13. The tool assembly, according to claim 12, wherein said coating is a plated coating so as to bond said coating to said insert.

14. The tool assembly, according to claim 1, wherein said coating has a hardness of HV 600.

15. The tool assembly, according to claim 14, wherein said coating has hardness two times greater than a hardness of said insert.

16. The tool assembly, according to claim 1, wherein said coating has an erosion resistance two times greater than an erosion resistance of said insert.

17. A method for fluid control in a wellbore, the method comprising the steps of:

applying a coating to an insert, assembling a tool comprised of a housing having an inlet and an outlet, said insert being mounted in said housing, and a cover fitted over said insert in said housing, said cover sealing said insert within said housing, wherein said insert comprises an inlet chamber, a vortex chamber, and a feedback chamber, said feedback chamber being in fluid connection with said vortex chamber and said inlet chamber, said inlet chamber being in fluid connection with said vortex chamber directly and through said feedback chamber, wherein said insert comprises:

a first input channel connecting said inlet chamber to one side of said vortex chamber;

a second input channel connecting said inlet chamber to an opposite side of said vortex chamber;

a first transition channel connecting said vortex chamber to one side of said feedback chamber;

a second transition channel connecting said vortex chamber to an opposite side of said feedback chamber;

a first flowback channel extending from said feedback chamber to said inlet chamber; and a second flowback channel extending from said feedback chamber to said inlet chamber, wherein said coating covers said inlet chamber, said first input channel, said second input channel, and said vortex chamber, wherein said inlet chamber, said vortex chamber, and said feedback chamber are in an asymmetric flow path, wherein said inlet chamber further comprises a switch means for the flow path alternating between said first input channel and said second input channel, wherein fluid flow through said insert has a pressure profile comprised of a plurality of levels determined by said feedback chamber, and wherein said pressure profile has a frequency determined by said feedback chamber, when said inlet chamber maintains a constant position and fluid connection to said vortex chamber;

installing said tool in a string;

flowing a fluid through said insert and over said coating;

alternating the flow path between said first input channel and said second input channel; and generating vibrations in said tool according to the pressure profile, wherein said inlet chamber is in fluid connection with said inlet of said housing, and wherein said vortex chamber is in fluid connection with said inlet chamber, said vortex chamber having an output in fluid connection to said outlet of said housing.

18. The method for fluid control, according to claim 17, the step of flowing being further comprised of the steps of:

generating a first fluid flow from said input chamber to said first input channel and to said vortex chamber in a first direction around said vortex chamber;

switching the flow path between said first input channel and said second input channel; and generating a second fluid flow from said input chamber to said second input channel and to said vortex chamber in a second direction around said vortex chamber, said second direction being opposite said first direction.

19. The method for fluid control, according to claim 17, the step of applying a coating to an insert being further comprised of the steps of:

sintering at least one of a group consisting of carbide, oxide, nitride, and silicide so as to bond said coating to said insert.

20. The method for fluid control, according to claim 17, the step of applying a coating to an insert being further comprised of the steps of:

plating at least one of a group consisting of chrome and electroless nickel so as to bond said coating to said insert.

* * * * *